US006069643A

United States Patent [19]

Yoshida et al.

[11] Patent Number: 6,069,643

[45] Date of Patent: May 30, 2000

[54] THERMAL TRANSFER RECORDING APPARATUS AND METHOD TO REDUCE INK SHEET STICKING

[75] Inventors: Takehiro Yoshida, Tokyo; Makoto Kobayashi, Tama; Hisao Terajima; Takeshi Ono, both of Yokohama; Satoshi Wada, Kawasaki; Minoru Yokoyama; Akihiro Tomoda, both of Yokohama; Yasushi Ishida, Tokyo; Takashi Awai, Yokohama, all of Japan

[73] Assignee: Canon Kabushiki Kaisha, Tokyo, Japan

[21] Appl. No.: 08/413,932

[22] Filed: Mar. 30, 1995

Related U.S. Application Data

[63] Continuation of application No. 08/049,659, Apr. 22, 1993, which is a continuation of application No. 07/433,991, Nov. 9, 1989.

[30] Foreign Application Priority Data

Nov. 9, 1988 [JP] Japan ..... 63-281374
Nov. 9, 1988 [JP] Japan ..... 63-281375

[51] Int. Cl.[7] ..... B41J 2/38

[52] U.S. Cl. ..... 347/186; 347/180; 347/181; 347/182; 347/185; 347/187

[58] Field of Search ..... 347/180, 181, 347/182, 185, 186, 187

[56] References Cited

U.S. PATENT DOCUMENTS

| | | | |
|---|---|---|---|
| 4,432,001 | 2/1984 | Inui et al. | 347/186 |
| 4,449,136 | 5/1984 | Moriguchi et al. | 346/76 PH |
| 4,456,392 | 6/1984 | Nozaki et al. | 400/120 |
| 4,463,359 | 7/1984 | Ayata et al. | 346/1.1 |
| 4,520,373 | 5/1985 | Ayata et al. | 346/140 R |
| 4,531,133 | 7/1985 | Leng | 346/76 PH |
| 4,568,817 | 2/1986 | Leng et al. | 346/76 PH |
| 4,636,810 | 1/1987 | Asakura et al. | 346/76 PH |
| 4,675,698 | 6/1987 | Tsutsumi | 346/76 PH |
| 4,760,462 | 7/1988 | Ogawa | 346/76 PH |
| 4,814,789 | 3/1989 | Ono | 346/76 PH |
| 4,837,813 | 6/1989 | Terajioma | 379/113 |
| 4,875,056 | 10/1989 | Ono | 347/180 |

FOREIGN PATENT DOCUMENTS

| | | | |
|---|---|---|---|
| 0219119 | 4/1987 | European Pat. Off. . | |
| 0295953 | 12/1988 | European Pat. Off. . | |
| 0181365 | 10/1983 | Japan | 346/76 PH |
| 58-201686 | 11/1983 | Japan . | |
| 0211473 | 12/1983 | Japan | 346/76 PH |
| 255463 | 12/1985 | Japan | 347/186 |
| 49867 | 3/1986 | Japan | 347/186 |
| 62-3969 | 1/1987 | Japan . | |
| 0094360 | 4/1987 | Japan | 346/76 PH |
| 62-173267 | 7/1987 | Japan . | |
| 0257863 | 11/1987 | Japan | 346/76 PH |
| 4970 | 1/1988 | Japan | 347/186 |

OTHER PUBLICATIONS

Eur. Pat. Off. Search Report for Eur. Pat. App. 89120815.9.

*Primary Examiner*—Huan Tran
*Attorney, Agent, or Firm*—Fitzpatrick, Cella, Harper & Scinto

[57] ABSTRACT

A thermal transfer recording apparatus for performing recording of data on a recording medium by transferring ink of an ink sheet on said recording medium comprises conveying means for conveying said ink sheet and recording medium, recording means for effecting said ink sheet to record image data on said recording medium, and control means for counting time after image recording by said recording means and driving said recording means when the next image recording is not performed in a predetermined time period.

29 Claims, 14 Drawing Sheets

| FIG. 1A |
| --- |
| FIG. 1B |

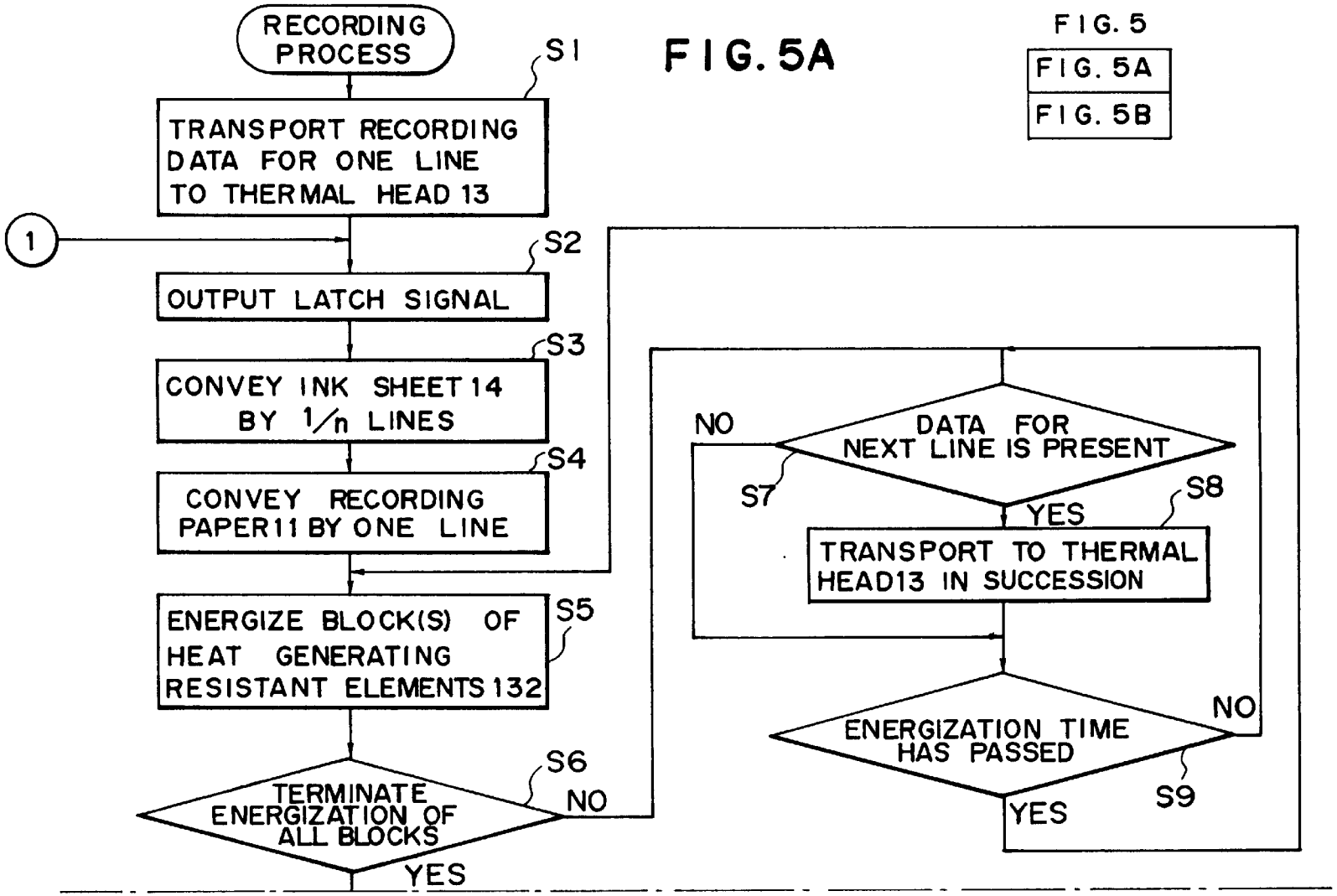
FIG. 5
FIG. 5A
FIG. 5B
FIG. 5A
RECORDING PROCESS
S1
TRANSPORT RECORDING DATA FOR ONE LINE TO THERMAL HEAD 13
S2
OUTPUT LATCH SIGNAL
S3
CONVEY INK SHEET 14 BY 1/n LINES
S4
CONVEY RECORDING PAPER11 BY ONE LINE
S5
ENERGIZE BLOCK(S) OF HEAT GENERATING RESISTANT ELEMENTS 132
S6
TERMINATE ENERGIZATION OF ALL BLOCKS
NO
YES
S7
DATA FOR NEXT LINE IS PRESENT
NO
YES
S8
TRANSPORT TO THERMAL HEAD13 IN SUCCESSION
S9
ENERGIZATION TIME HAS PASSED
NO
YES
1

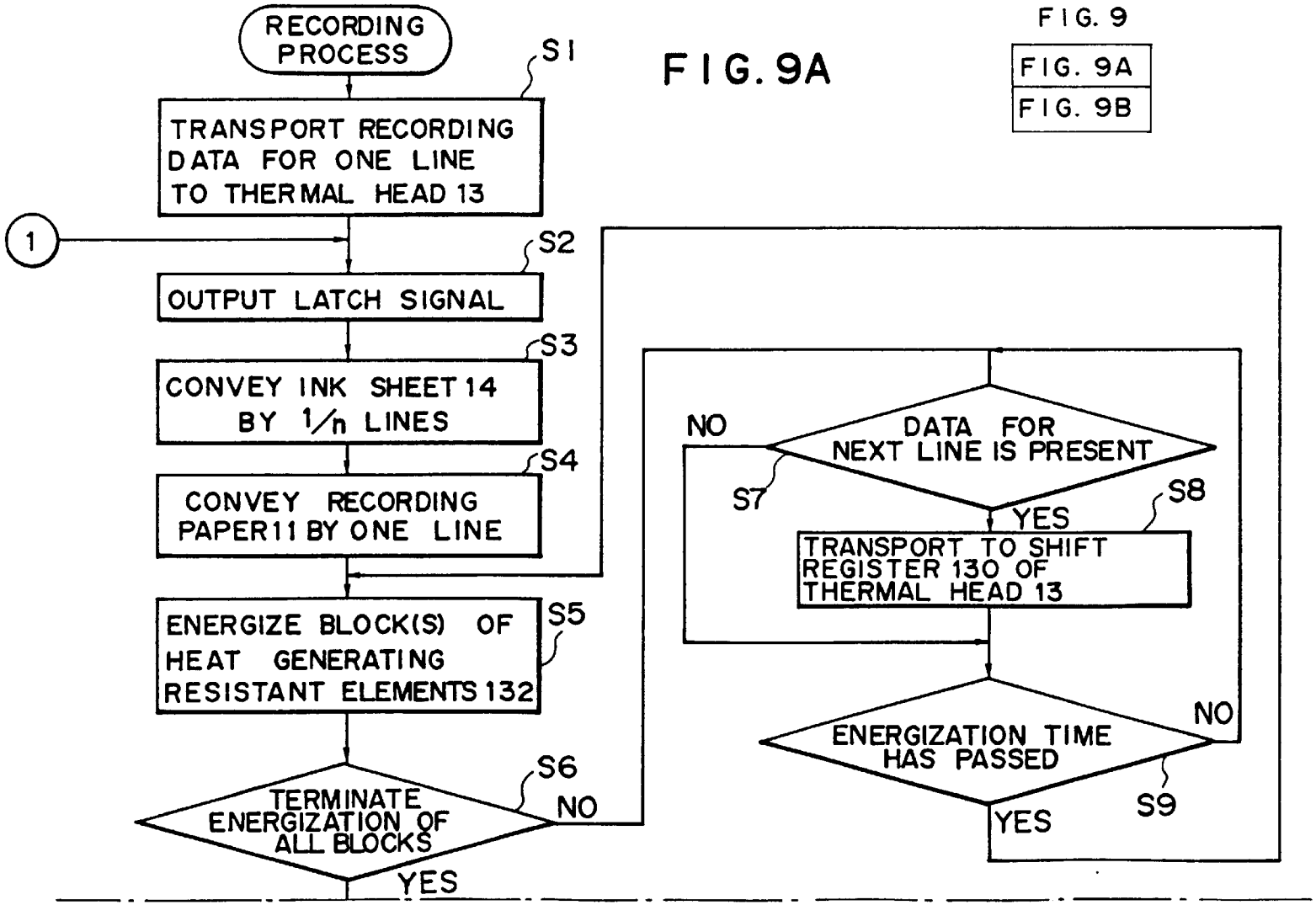
FIG. 9
FIG. 9A
FIG. 9B
FIG. 9A
RECORDING PROCESS
S1
TRANSPORT RECORDING DATA FOR ONE LINE TO THERMAL HEAD 13
S2
OUTPUT LATCH SIGNAL
S3
CONVEY INK SHEET 14 BY 1/n LINES
S4
CONVEY RECORDING PAPER 11 BY ONE LINE
S5
ENERGIZE BLOCK(S) OF HEAT GENERATING RESISTANT ELEMENTS 132
S6
TERMINATE ENERGIZATION OF ALL BLOCKS
NO
YES
1
S7
DATA FOR NEXT LINE IS PRESENT
NO
YES
S8
TRANSPORT TO SHIFT REGISTER 130 OF THERMAL HEAD 13
S9
ENERGIZATION TIME HAS PASSED
NO
YES

THERMAL TRANSFER RECORDING APPARATUS AND METHOD TO REDUCE INK SHEET STICKING

This application is a continuation of application Ser. No. 08/049,659 filed Apr. 22, 1993, which is a continuation of application Ser. No. 07/433,991 filed Nov. 9, 1989.

BACKGROUND OF THE INVENTION

1. Field of the Invention

This invention relates to a thermal transfer recording apparatus and facsimile apparatus, in which ink of an ink sheet is transferred onto a recording medium for recording image thereon.

2. Related Background Art

A thermal transfer printer usually uses an ink sheet with a thermally fusible (or thermally sublimable) ink coated on a base film. The ink sheet is selectively heated according to an image signal by a thermal head to transfer fused (or sublimed) ink onto a recording sheet to record an image. Usually, with this ink sheet ink is perfectly transferred onto a recording sheet by a single image recording operation (so-called one time sheet). Therefore, it is necessary to convey the ink sheet to an extent corresponding to the recording length after completion of recording of one character or one line, and it is required to surely bring a non-used portion of the ink sheet to next recording position. Accordingly, greater amount of ink sheet is used and as compared with a usual heat-sensitive printer for recording on a heat-sensitive sheet, a higher running cost is required for the thermal transfer printer.

To solve the above problems, a thermal transfer printer, in which a recording sheet and an ink sheet are conveyed at different speeds, is proposed as disclosed in U.S. Pat. No. 4,456,392, Japanese Patent Publication No. 58-201686 and Japanese Patent Publication (examined) No. 62-58917. As disclosed in these literature, an ink sheet capable of a plurality of (i.e., n) times of image recording (so-called multiple print sheet) is known in the art. By using this ink sheet, when a recording length L is continuously recorded, the ink sheet which is conveyed after or during each image recording may be conveyed by a smaller length than the length L (L/n: n>1). Thus, the efficiency of use of ink sheet is increased n times as compared with the prior art, and thus it is expected to reduce the running cost of the thermal transfer printer. This recording system is hereinafter referred to as multi-printing.

In the multi-printing using the above ink sheet, ink of the ink layer of the ink sheet is heated by n times. In each heating, a shearing force is generated between fused (or sublimed or like) and non-fused (or non-sublimed or like) ink of the ink layer to effect transfer of ink onto a recording sheet or paper. For this reason, when time from the recording of one line to the recording of the next line is increased to reduce ink temperature, the shearing force between fused (or sublimed) ink and non-fused (or non-sublimed) ink is increased, thus the ink sheet may be difficult to separate from the recording sheet. This is particularly pronounced when recording data of one line contains many black data. Further, this causes remarkable problems in a facsimile apparatus or the like, in which the time interval between one line and the next line is not fixed and tends to be comparatively long.

SUMMARY OF THE INVENTION

An object of the invention is to provide a thermal transfer recording apparatus and a facsimile apparatus which can provide an improved image quality.

Another object of the invention is to provide a thermal transfer recording apparatus and a facsimile apparatus, which can obtain a clear or fine image.

A further object of the invention is to provide a thermal recording apparatus and a facsimile apparatus, which can reduce the consumption of an ink sheet.

A yet further object of the invention is to provide a thermal transfer recording apparatus and a facsimile apparatus, in which when the next recording operation is not performed after previous recording operation for more than a predetermined time period, the separation of the ink sheet and recording medium from each other after image recording is facilitated by heating recording means until next recording operation.

A further object of the invention is to provide a thermal transfer recording apparatus and a facsimile apparatus, in which when after recording the same data is recorded once again with the recording medium held stationary, and also when recording operation is not made for more than a predetermined time period the recording means is heated until the next recording operation, thus improving the quality of the recording image and facilitating the separation of ink sheet and recording medium from each other after image recording.

DETAILED DESCRIPTION OF THE PREFERRED EMBODIMENT

Now, a preferred embodiment of the invention will now be described in detail with reference to the accompanying drawings.

[Description of Facsimile Apparatus (FIGS. 1 to 4)]

Figures 1, 1A:
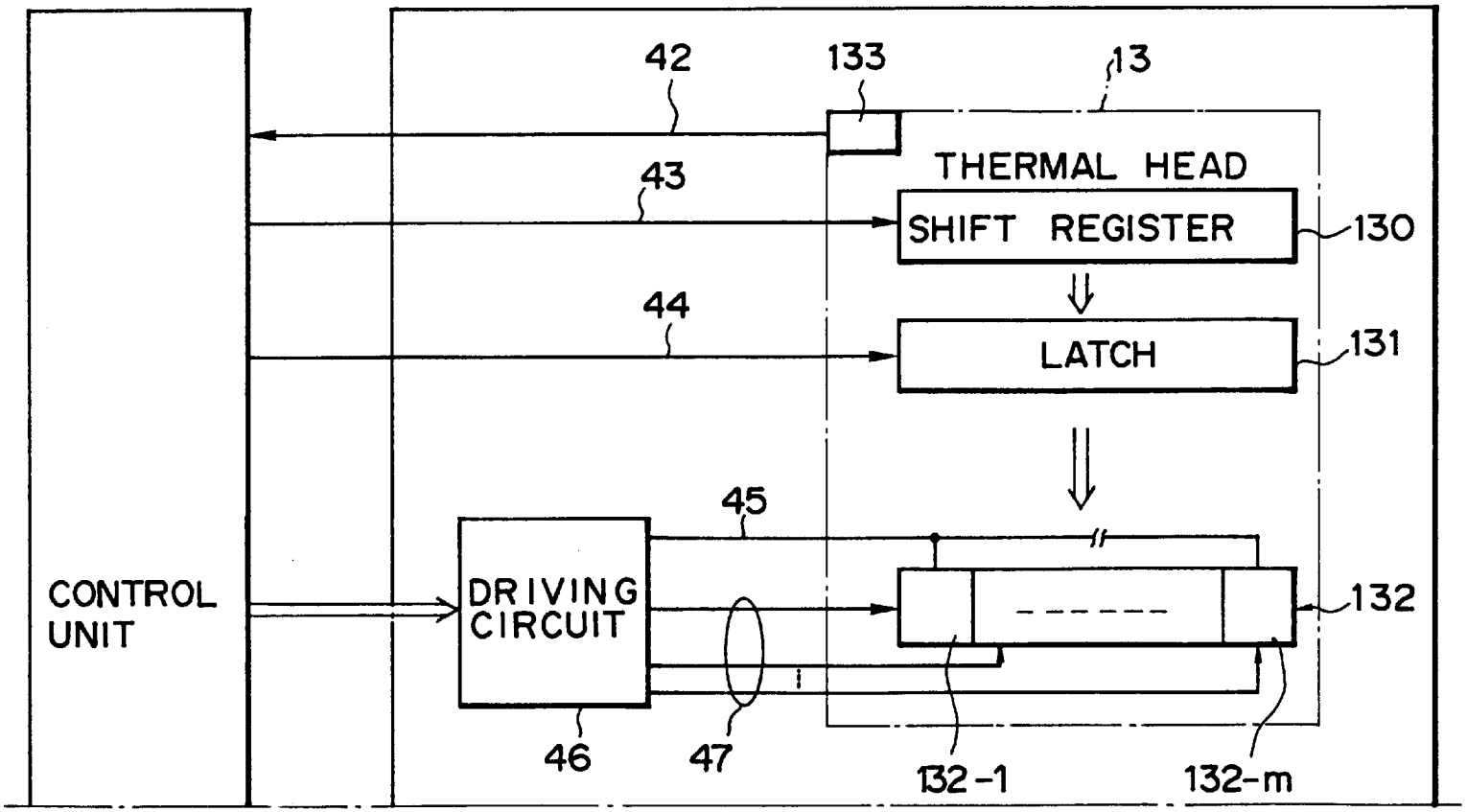
FIG. 1, consisting of FIGS. 1A and 1B, is a block diagram showing the electric connection between a control unit and a recording unit of an embodiment of the invention.
Figure 1B:
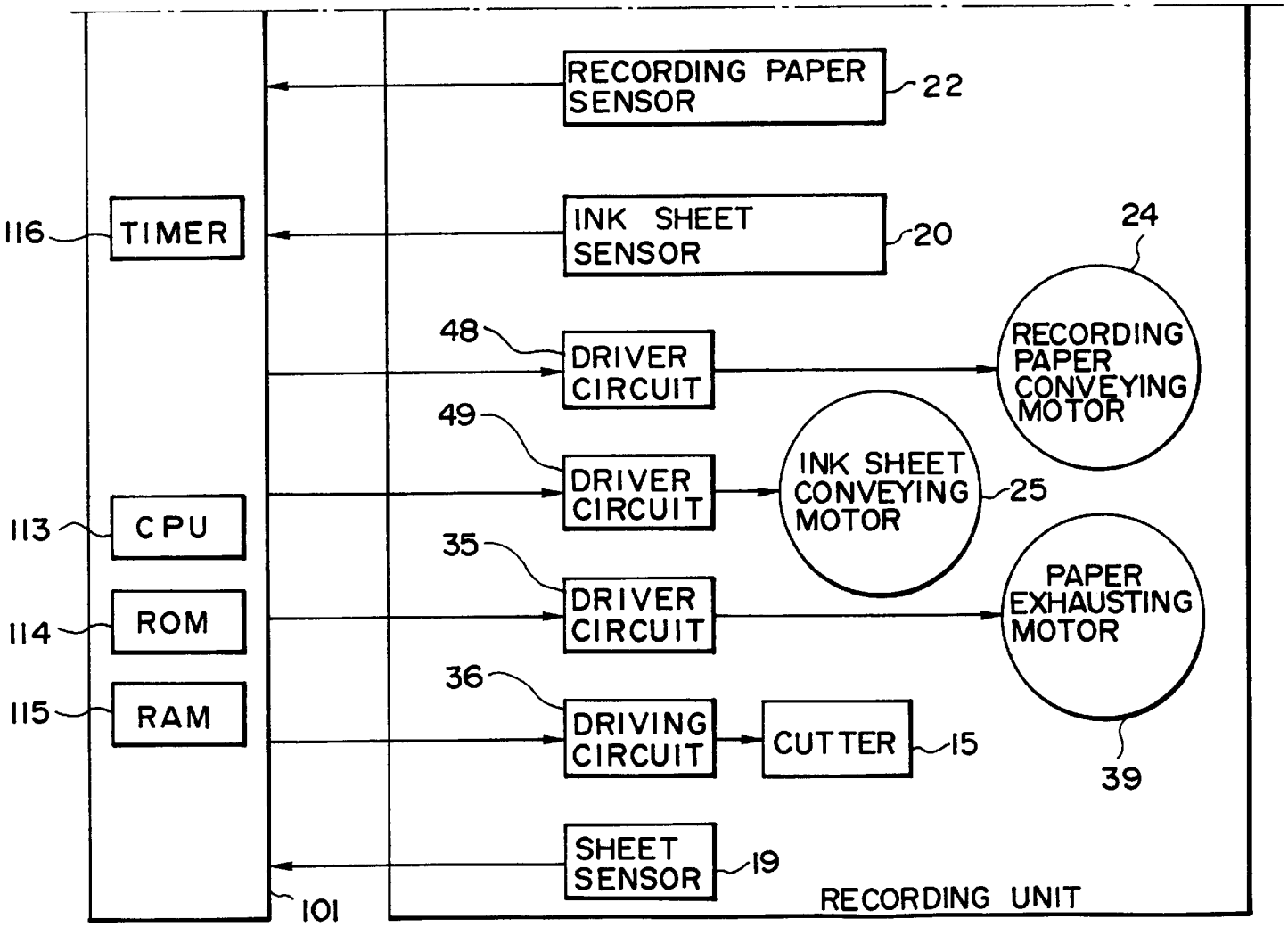
Figure 2:
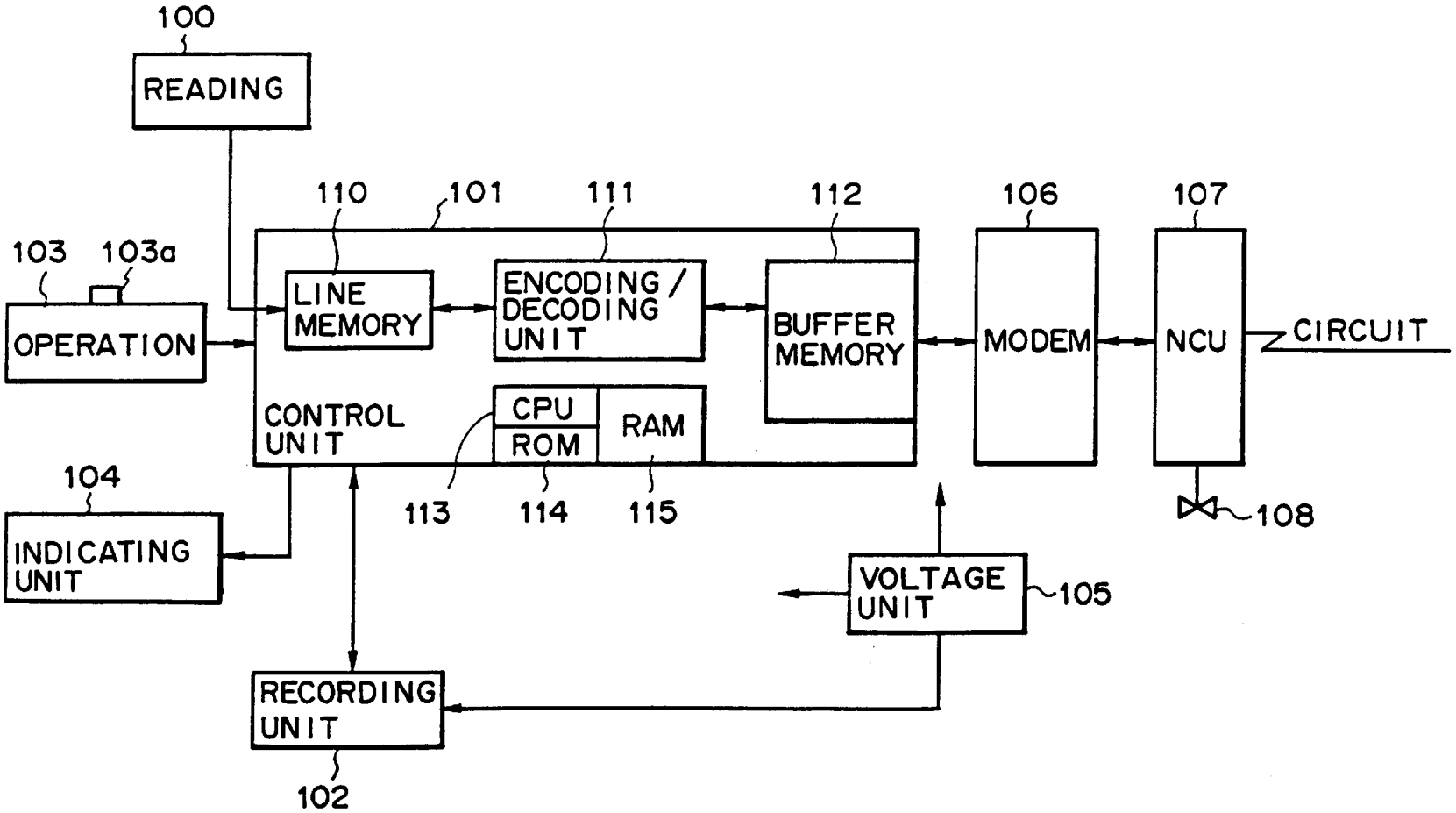
FIG. 2 is a block diagram showing the schematic construction of a facsimile apparatus embodying the invention.
Figure 3A:
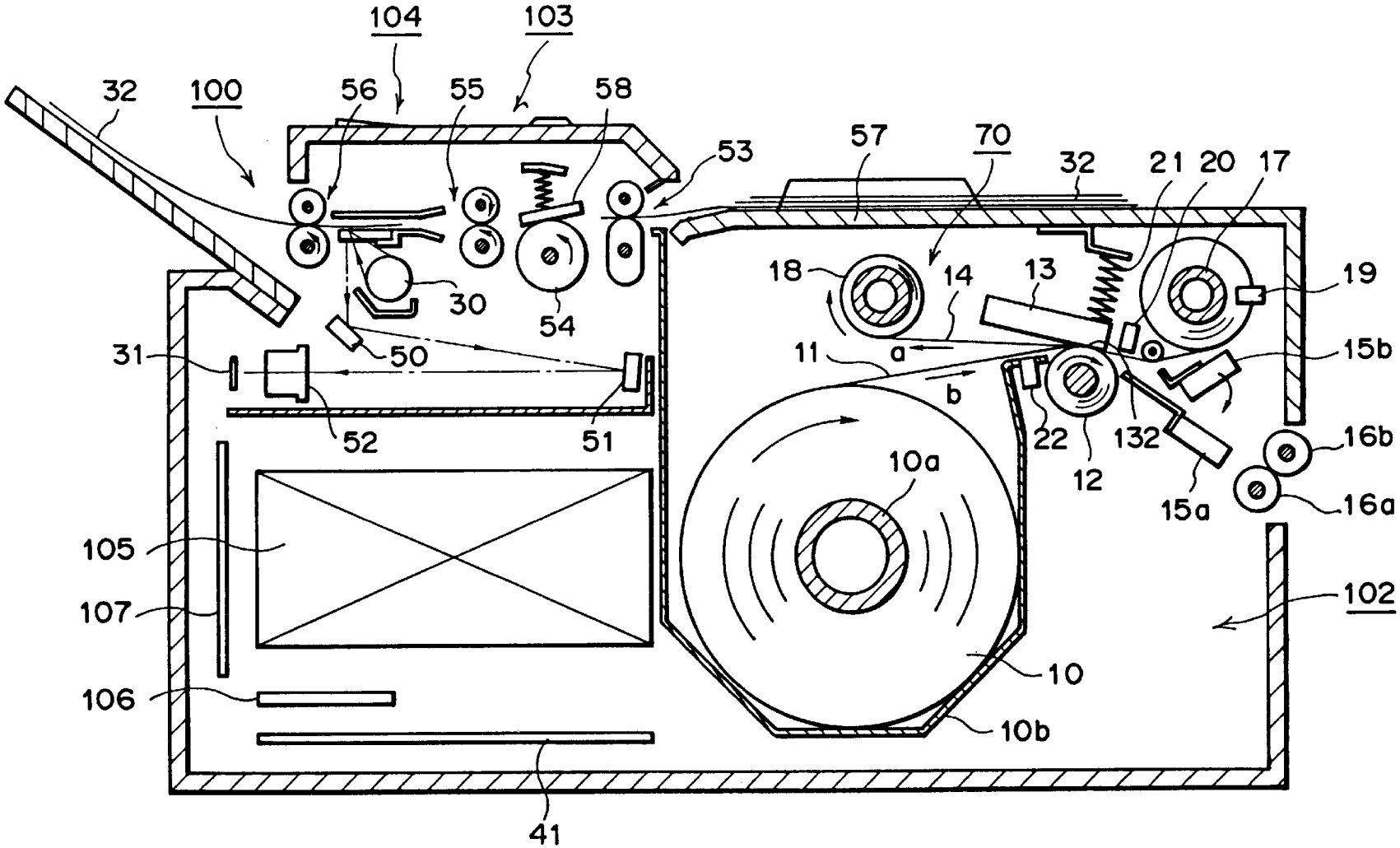
FIG. 3A is a sectional view showing a mechanical section of the embodiment of the facsimile apparatus.
Figure 3B:
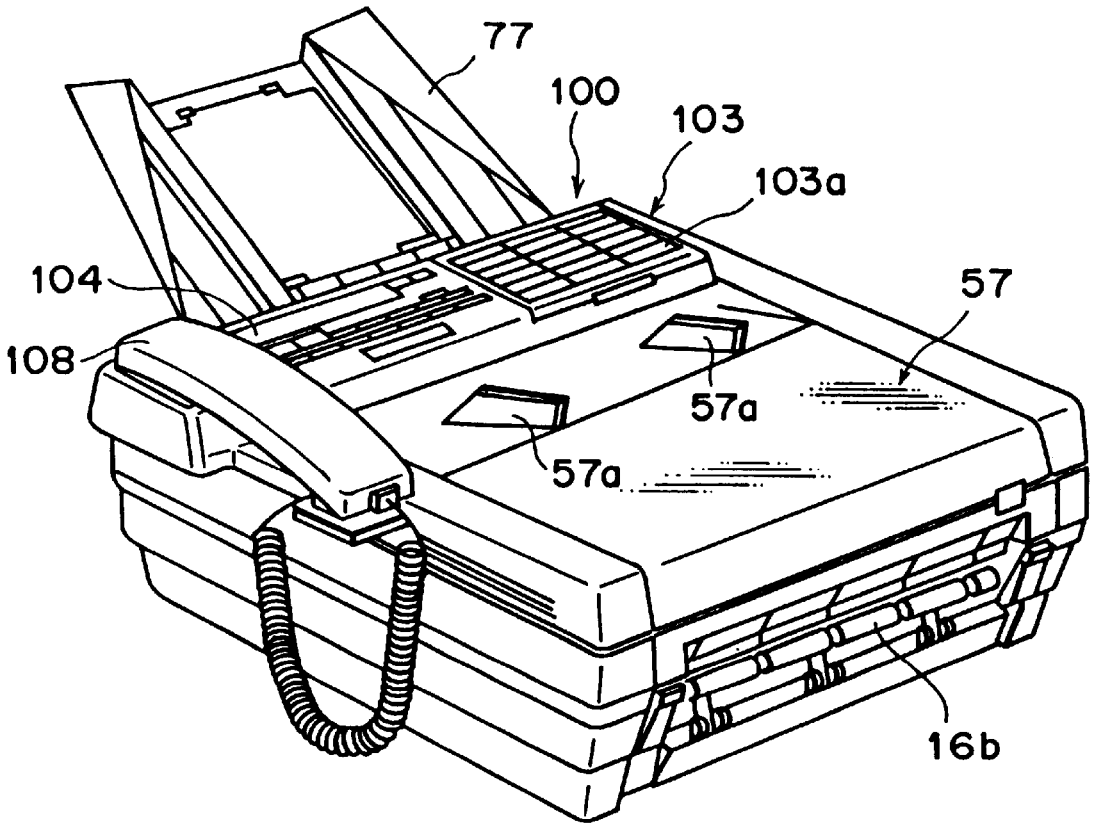
FIG. 3B is a perspective view showing the facsimile apparatus.
Figure 4:
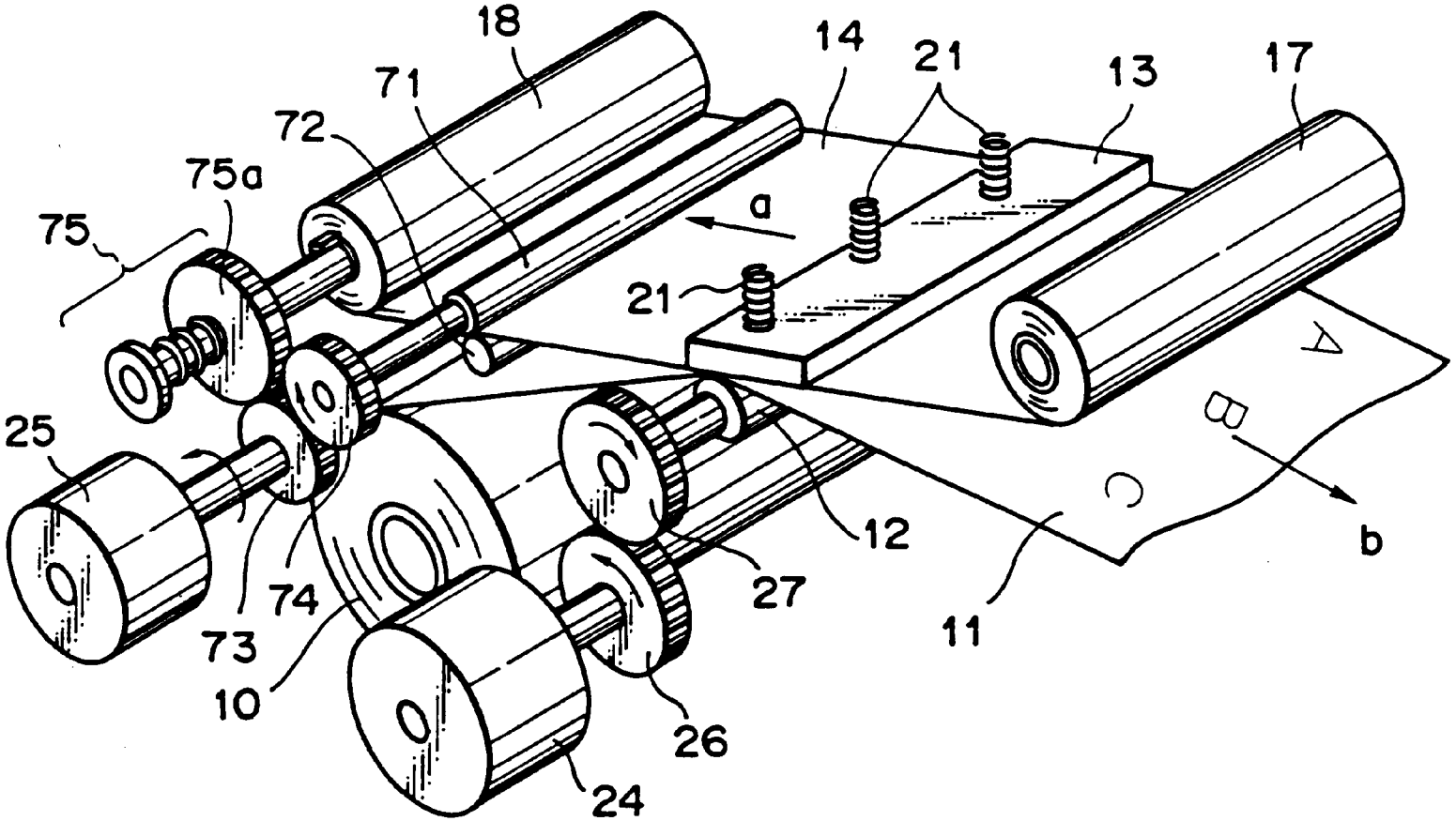
FIG. 4 is a view showing the structure of a system for conveying ink sheet and recording sheet.

FIGS. 1 to 4 illustrate one embodiment of the thermal transfer printer according to the invention applied to a facsimile apparatus. FIG. 1 is a view showing the electric connection between a control unit 101 and a recording unit 102 of the facsimile apparatus. FIG. 2 is a block diagram showing the construction of the facsimile apparatus; FIG. 3A is a sectional view showing the facsimile apparatus; FIG. 3B is a perspective view the facsimile apparatus; and FIG. 4 is a view showing a mechanism for conveying recording paper or sheet and ink sheet.

The construction of the facsimile apparatus will now be described briefly with reference to FIG. 2. Reference numeral 100 is a reading unit for photoelectrically reading an original and providing a digital image signal obtained by to control unit 101. The unit 100 includes an original conveying motor and a CCD image sensor. Now, the construction of the control unit 101 will be described. Reference numeral 110 designates a line memory for storing image data of individual lines. When transmitting or copying an original, image data for one line from the reading unit 100 is stored in the memory, while when receiving image data, decoded receiving image data for one line is stored. The stored data is provided to the recording unit 102 for image formation. Reference numeral 111 designates an encoding/decoding unit for encoding image data to be transmitted by MH encoding or the like and decoding received coded image data to convert them to the image data. Reference nuemral 112 is a buffer memory for storing transmitted or received encoded image data. The individual components of the control unit 101 are controlled by CPU 113, for instance a microprocessor. The control unit 101 includes, in addition to CPU 113, ROM 114 for storing control programs of CPU 113 and various data and RAM 115 for temporarily storing various data as work areas of CPU 113.

Reference numeral 102 designates the recording unit 102, which includes a thermal line head and performs recording of image on a recording sheet by a thermal transfer recording process. The construction of the recording unit 102 will be described in detail with reference to FIG. 3. Reference numeral 103 designates an operation unit including various function instruction keys such as one for instructing the start of transmission and also telephone number input keys, and a switch 103*a* designates the kind of ink sheet 14 to be used. When the switch 103*a* is turned "on", it indicates that a multi-print ink sheet is mounted, while when it is turned "off", it indicates that a usual ink sheet is mounted. Reference numeral 104 designates an indicating unit generally provided adjacent to the operation unit 103 for indicating various functions and status of apparatus. Reference numeral 105 designates a power unit or voltage source for supplying power to the whole apparatus. Reference numeral 106 designates modem modulation and (demodulation device), 107 a network control unit (NCU), and 108 a telephone set.

Now, the construction of recording unit 102 will be described in detail with reference to FIG. 3. Parts common to FIG. 2 are designated by the same reference numerals.

Referring to the Figure, reference numeral 10 designates a recording sheet 11, which is ordinary paper sheet and is wound as a roll on a core 10*a*. This roll sheet 10 is rotatably accommodated in the apparatus such that recording sheet 11 can be supplied to the thermal head section 13 upon rotation of a platen roller 12 in the direction of arrow. Reference numeral 10*b* is a roll sheet loader, in which the roll sheet 10 is detachably loaded. The platen roller 12 conveys the recording sheet 11 in the direction of arrow b and urging the ink sheet 14 or the recording sheet 11 against a heat generating resistant element or a heat generator 132 of the thermal head 13. The recording sheet 11 on which image is recorded by the heat generation of the thermal head 13 is conveyed toward discharge rollers 16*a* and 16*b* with further rotation of the platen roller 12. When recording of image for one page is completed, the recording sheet 11 is cut for one page by meshing of cutters 15*a* and 15*b* to be discharged.

Reference numeral 17 designates an ink sheet supply roll of the ink sheet 14, and 18 an ink sheet take-up roll, which is driven by an ink sheet conveying motor to be described later to take up the ink sheet 14 in the direction of arrow a. The ink ribbon supply and take-up rolls 17 and 18 are loaded in an ink ribbon loader unit 70 in the apparatus body. Further, reference numeral 19 designates a sensor for detecting the residual amount of the ink sheet 14 and the conveying speed of the ink sheet 14. Reference numeral 20 is an ink sheet sensor for detecting presence/absence of the ink sheet 14, 21 a spring for urging the thermal head 13 against the platen roller 12 through the recording sheet 11 and the ink sheet 14. Reference numeral 22 designates a recording sheet sensor for detecting presence/absence recording sheet.

Now, the construction of the recording unit 100 will be described.

Referring to the Figure, reference numeral 30 designates a light source for illuminating an original 32. Light reflected by the original 32 is put into a CCD sensor 31 through an optical system including mirrors 50, 51 and lens 52 and converted into an electric signal. The original 32 is conveyed in accordance with the reading speed of the original 32 by conveying rollers 53 to 56 driven by an original conveying motor (not shown). Reference numeral 57 designates an original support. A plurality of the originals 32 stacked on the original support 57 are guided by a slider 57*a* and separated one by one with cooperation of the conveying roller 54 and an urging separating member 58. Then they are conveyed to reading unit 100 and after reading they are discharged or exhausted to a tray 77.

Reference numeral 41 designates a control board constituting a main part of control unit 101 and providing various control signals to various parts of the apparatus. Reference numeral 106 is a modem board unit, and 107 a NCU board unit.

Further, FIG. 4 is a view showing the details of mechanism for conveying the ink sheet 14 and the recording sheet 11.

Referring to the Figure, reference numeral 24 designates the recording sheet conveying motor for driving the platen roller 12 to convey the recording sheet 11 in the direction of arrow b opposite to the direction of arrow a. Reference numeral 25 designates the ink sheet conveying motor for conveying the ink sheet 14 through a capstan roller 71 and a pinch roller 72 in the direction of arrow a. Reference numerals 26 and 27 designate gears for transmitting the rotation of the recording sheet conveying motor 24 to the platen roller 12, and 73 and 74 gears for transmitting the rotation of the ink sheet conveying motor 25 to the capstan roller 71. Reference numeral 75 designates a slip clutch unit.

The gear ratio of gears 74 and 75 is set such that the length of the ink sheet 14 taken up by the take-up roller 18 with the rotation of the gear 75*a* is greater than the length of the ink sheet 14 conveyed by the capstan roller 71. Accordingly, the ink sheet 14 conveyed by the capstan roller 18 is reliably taken up by the take-up roller 18. The slip clutch unit 75 absorbs an amount of the ink sheet corresponding to the difference between an amount of the ink sheet wound on the take-up roll 18 and an amount of the ink sheet fed by the capstan roller 71. Thus, it is possible to suppress variation of the conveying speed (or amount) of the ink sheet 14 caused by variation of the take-up diameter of the take-up roll 18.

FIG. 1 shows the connection of an electric system between the control unit 101 and the recording unit 102 in an embodiment of the invention applied to a facsimile system. Parts like those in other Figures are designated by the same reference numerals.

A thermal head 13 is a line head. The thermal head 13 includes a shift register 130, to which serial recording data for one line from the control unit 101 and a shift clock 43 are supplied, a latch circuit 131 for latching data of the shift register 130 according to a latch signal 44 and a heat-generating element 132 consisting of a plurality of heat-generating resistant elements or resistors for one line. The heat-generating element 132 is divided into m blocks 132-1 to 132-m to drive. Reference numeral 133 is a temperature sensor mounted on thermal head 13 for detecting the temperature of the thermal head 13. An output signal 42 from the temperature sensor 133 is A/D converted in the control unit 101 and input to CPU 113. Thus, CPU 113 detects the temperature of the thermal head 13 and changes the pulse width of a strobe signal 47 or drive voltage of the thermal head 13 according to the detected temperature. In this way, the energy applied to the thermal head 13 is changed according to the characteristics of the ink sheet 14. Reference numeral 116 is a programmable timer, a counting time of which is set by CPU 113, and which starts counting when the start is instructed. The timer 116 outputs an interruption signal and a time-out signal to CPU 113 at each indicated timing.

The kind (or characteristics) of the ink sheet 14 may be discriminated by a switch 103*a* on the operation unit 103 noted above or by detecting a mark printed on the ink sheet 14. It is also possible to effect discrimination by judging marks, notches or protuberances provided on the ink sheet cartridge.

Reference numeral 46 designates a drive circuit which receives a drive signal for driving the thermal head 13 from the control unit 101 and provides a strobe signal 47 for driving the thermal head 13 by blocks. The driving circuit 46 can change energy applied to the thermal head 13 by changing the voltage to be output to a power line 45 which supplies current to the heat-generating element 132 of the thermal head 13. Reference numeral 36 designates a drive circuit for driving the cutter 15 and includes a cutter drive motor or the like. Reference numeral 39 designates a paper discharge motor for driving the discharge roller 16 to rotate. Reference numerals 35, 31 and 32 designate driver circuits for driving the discharge motor 39, the recording sheet conveying motor 24 and the ink sheet conveying motor 25. In this embodiment, the motors 39, 24, and 25 are stepping motors, but this is by no means limitative; for instance they may be DC motors.

[Description of Recording Operation (FIGS. 1 to 5, 8)]

Figure 5B:
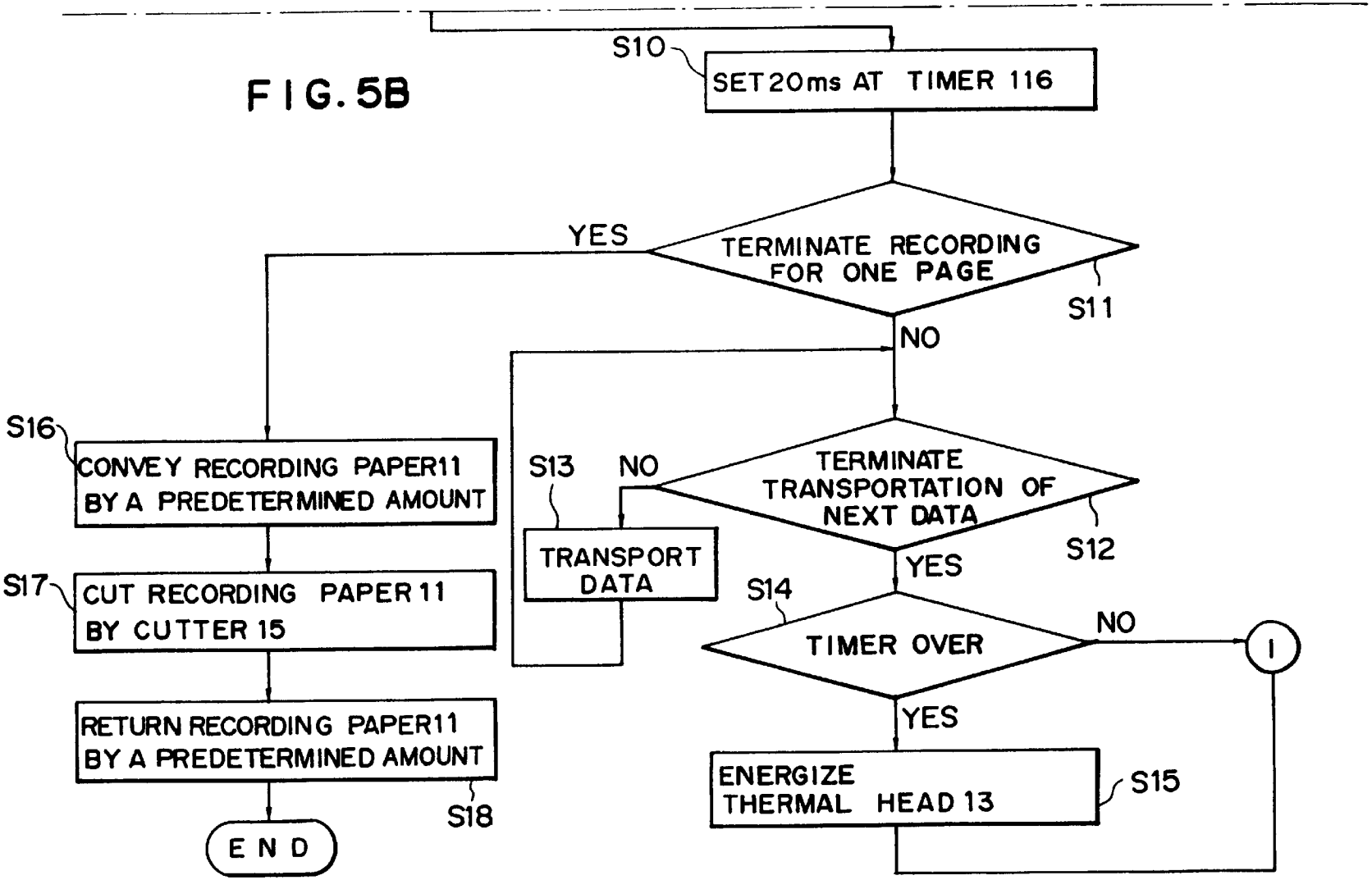
FIG. 5, consisting of FIGS. 5A and 5B, is a flow chart showing a recording process of this embodiment.

FIG. 5 is a flow chart illustrating a process for recording image for one page in the facsimile apparatus of this embodiment. Control programs for executing the process are stored in ROM 114 of the control unit 101.

The process begins when the image data for one line for recording is stored in the line memory 110 and the recording operation is ready to start. It is assumed that it is found in the control unit 101 by the switch 103*a* that the multi-print ink sheet is mounted.

In step S1, recording data for one line is output as serial data to the shift register 130. In step S2, the latch signal 44 is output for storing the recording data for one line in the latch circuit 131 after termination of transportation of the recording data for one line. Then, in step S3 the ink sheet 14 for 1/n lines is conveyed by driving the ink sheet conveying motor 25. In step S4, the recording sheet 11 is conveyed for one line. With this embodiment of the facsimile apparatus, the length of one line is set to about 1/15.4 mm. The conveying amounts of the recording sheet 11 and the ink sheet 14 can be set by changing the number of excitation pulses of the recording sheet and the ink sheet conveying motors 24 and 25 respectively.

Subsequently, in step S5 one of the blocks of the heat-generating resistor 132 is energized for recording image, and in step S6 it is checked whether all blocks of the thermal head 13 are energized. If it is not detected in step S6 that all blocks of the thermal head 13 are energized, step S7 is executed, in which it is checked whether recording data for the next line is ready. If the data is ready, step S8 is executed to transport the recording data of the next line progressively to the shift register 130 of the thermal head 13. In step S9, whether an energization time for one block has passed is checked during transferring the data to the thermal head 13. If the energization time (which is about 600 $\mu$s) has not passed, the routine returns to step S7. If the energization time has passed, the process returns to step S5 for executing the heat generation drive operation (i.e., energization) for the next block. In this embodiment, the thermal head 13 is driven in four blocks, and recording for one line requires 2.5 ms (i.e., 600 $\mu$s by 4 blocks).

If it is found in step S6 that the energization of all the blocks, i.e., recording for one line, has been terminated, step S10 is executed, in which a predetermined time (for instance 20 ms) is set in the timer 116 for starting time counting by the timer 116. Then, step S11 is executed, in which it is checked whether recording of image for one page is terminated. If the recording for one page has not yet been ended, step S12 is executed, in which it is checked whether the next recording data has been transferred to the thermal head 13. If the data has not yet been transferred, step S13 is executed, in which a data transfer process for transferring data for the next line to the thermal head 13 is performed until the data is ready. When the data for one line to be recorded next is transferred to the thermal head 13, step S14 is executed, in which the timer 116, checks the time-out i.e., whether 20 ms has passed. If 20 ms has not yet been passed, the routine returns to step S2 to execute the recording process as noted before.

However, when 20 ms has been passed, step S15 is executed, in which the thermal head 13 is energized by blocks. At this time, data of the latch circuit 131 of the thermal head 13 is equal to the data which is recorded immediately before, so that the same data is recorded again. The energization of the thermal head 13 in step S15 is executed after the recording data for the next line has been transferred to the shift register 130 of the thermal head 13. Accordingly, the energization is executed right before the recording operation for the next line. The term "right before" means a delay due to process time from step S15 to step S5. Further, the time of energization of the thermal head 13 in step S15 may be the same as or shorter than the energization time in step S5.

When image recording for one page in step S11 is ended, step S16 is executed, in which the recording sheet 11 is conveyed toward the discharge rollers 16*a* and 16*b* by a predetermined amount. Then, in step S17 the cutters 15*a* and 15*b* are driven to cut the recording sheet 11 for one page after another. Then in step S18 the recording sheet conveying motor 24 is reversed, the recording sheet 11 is returned by a distance corresponding to the distance between the thermal head 13 and the cutters 15*a* and 15*b* to cut the recording sheet 11.

As has been shown, with this embodiment, when the recording time for each line exceeds a predetermined time, the thermal head 13 is heated again, thus reducing the shearing force of ink in the ink layer for obtaining satisfactory separation of the ink sheet 14 and the recording sheet 11 when the ink sheet 14 and the recording sheet 11 are conveyed in steps S3 and S4.

When driving the thermal head 13 in step S15, energy applied to the heat-generating elements 132 is reduced from the level at the time of actual recording to a level, at which no image is recorded. Further, when driving the thermal head 13 in step S15, heat-generating elements 132 corresponding to some black dots are energized in the same data as that of the preceding line, thus preventing ink from being solidified.

Figure 8:
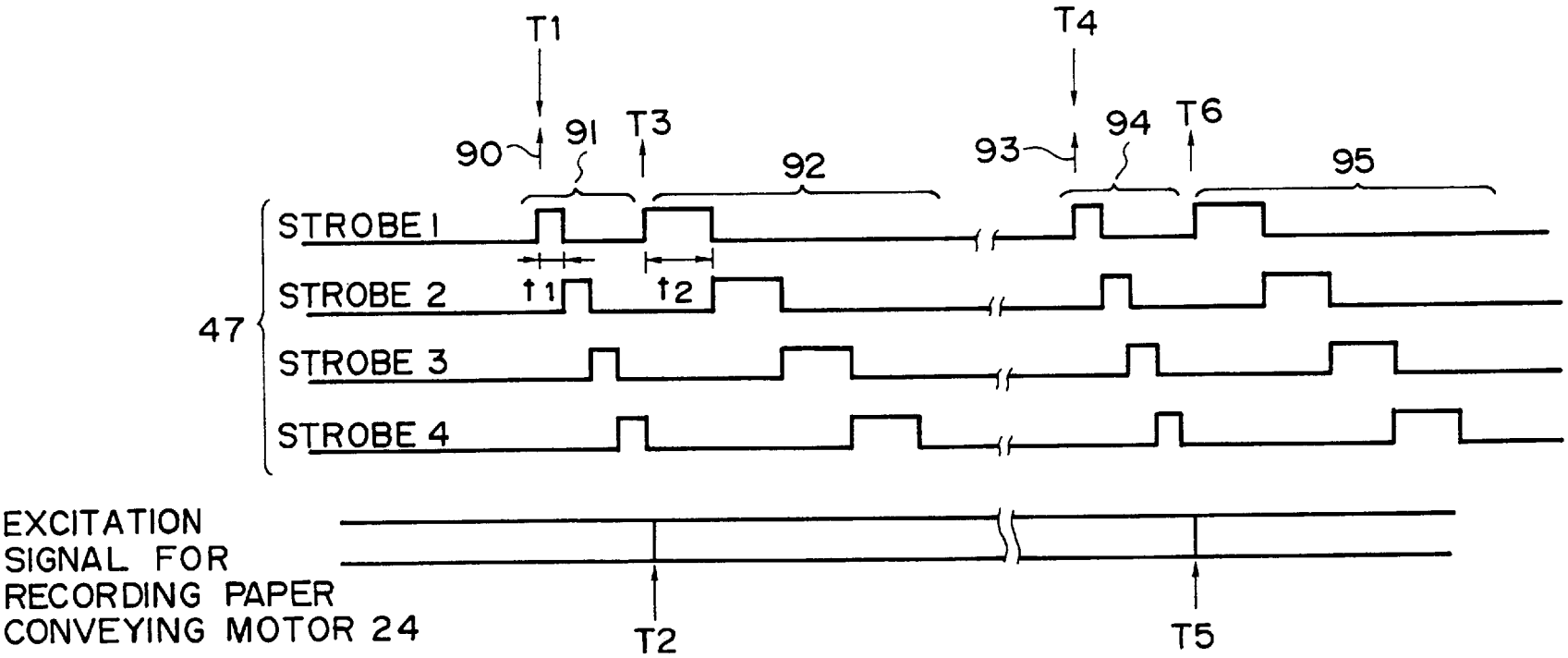
FIG. 8 is a timing chart showing timing of energization of thermal head in a recording process of this embodiment.

FIG. 8 shows timing of energization of the thermal head 13 in a recording process in this embodiment. Here, heat-generating resistors 132 of the thermal head 13 are energized in four blocks. Strobe signals 1 to 4 correspond to energization signals for the individual blocks of heat-generating resistors 132 of the thermal head 13.

Timing T1 is a time instant when the next line data is transferred to the thermal head 13 after end of recording the present line so that it is ready to record the next line data. If a predetermined time period (for instance 20 ms) has passed after the termination of recording for the present line, a one-line re-recording command is provided as shown at 91, and the four blocks of the thermal head 13 are energized as shown at 91 (step S15). Timing T2 is an excitation phase switching timing of the recording sheet conveying motor 24 in step S4. Then, the recording for the next line as shown at 92, is started with one-line data latched in the latch circuit 131 at timing T3 (step S5).

Likewise, timing T4 indicates an instant of completion of transfer of the next-line recording data to the thermal head 13. If a predetermined time period (i.e., 20 ms) has passed from the end of recording for the present line (line of recording shown at 92), a one-line re-recording command is output at 93. Consequently, the four blocks of thermal head 13 are energized as shown at 94 (step S15). In this way, the recording sheet conveying motor 24 is driven by one step at timing T5 (step S4), and the next-line data latched in the latch circuit 131 is recorded at timing T6 as shown at 95 (step S5). The above sequence of operations is repeated to effect recording.

Energization time $t_1$ of the blocks of the thermal head 13 as shown at 91 and 94 may be equal to or shorter than energization time $t_2$ for actual recording as shown at 95.

[Description of the Other Embodiment (FIGS. 6 and 7)]

Figure 6:
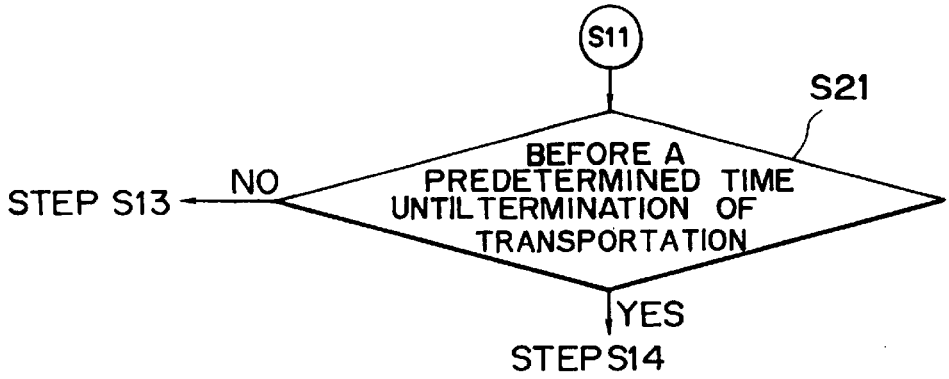
FIGS. 6 and 7 are flow charts concerning a different embodiment.
Figure 7:
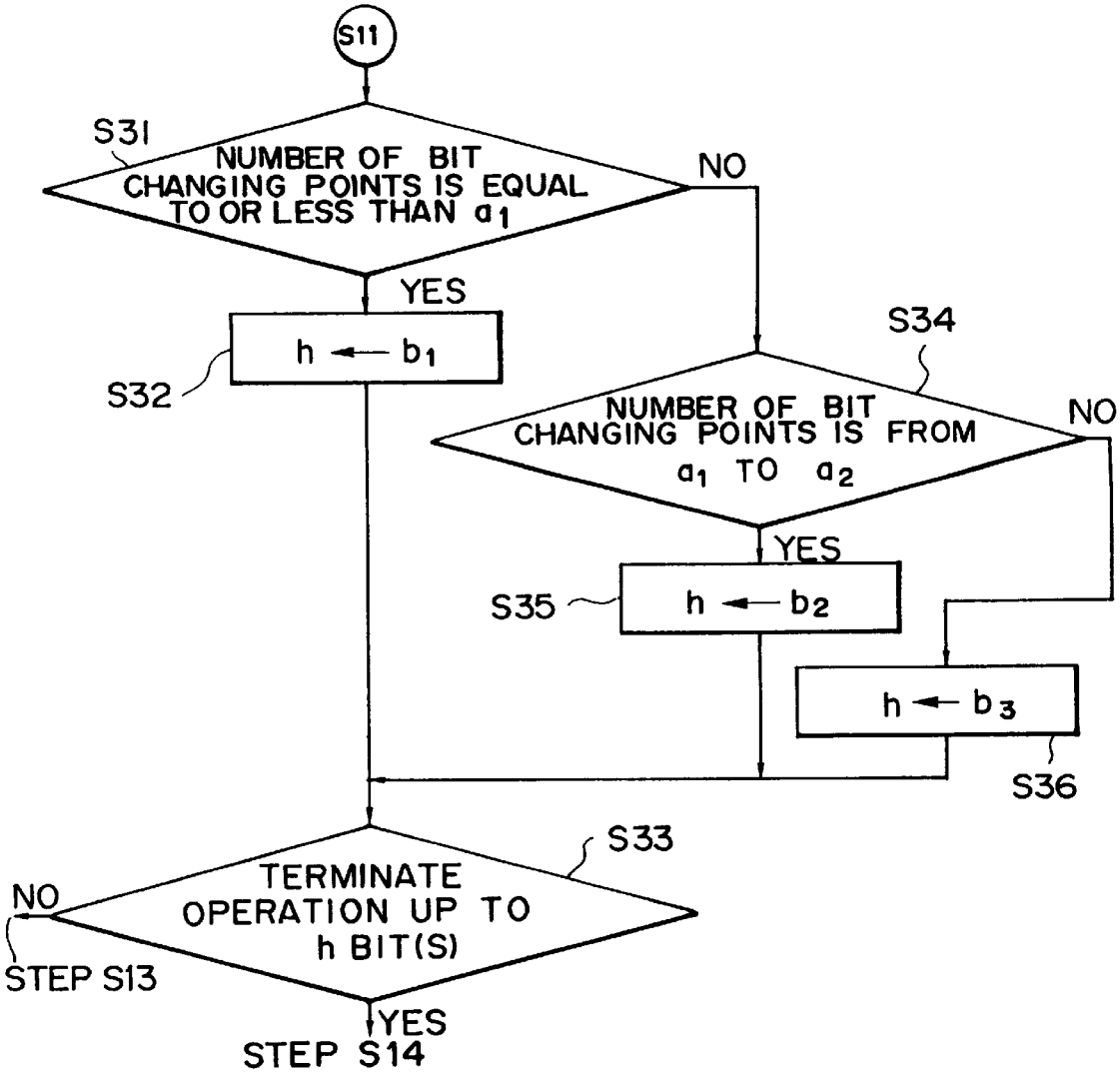

FIGS. 6 and 7 are flow charts concerning a different embodiment and illustrating a modification of step S12 shown in FIG. 5.

In the step shown in FIG. 6, it is checked whether it is before a predetermined time period to transfer the next-line data to the thermal head 13. If it is so, step S14 is executed. If the original image is of A4 size, it is checked whether 1,600 bits of the next-line data have been transferred to the thermal head 13.

FIG. 7 shows a modification of the process shown in FIG. 6. In this case, the number of changing points from white to black bit for one line of recording data is counted. If the number is below a1, h is set to b1 (1550) (in steps S31 and S32), if the number is between a1 and a2, h is set to b2 (1600) (in step S35). Otherwise, h is set to b3 (1650) (in step S36). In step S33, it is checked whether h bits of the next-line data have been transferred. If h bits have been transferred, step S14 is executed, in which it is checked whether 20 ms has passed.

Where the time of energization of the individual blocks of the thermal head 13 is set to 300 $\mu$s, for instance, the value of h in step S21 shown in FIG. 6 and also in FIG. 7 is set to a further greater value.

[Description of Further Embodiment (FIGS. 9 and 10)]

Figure 9B:
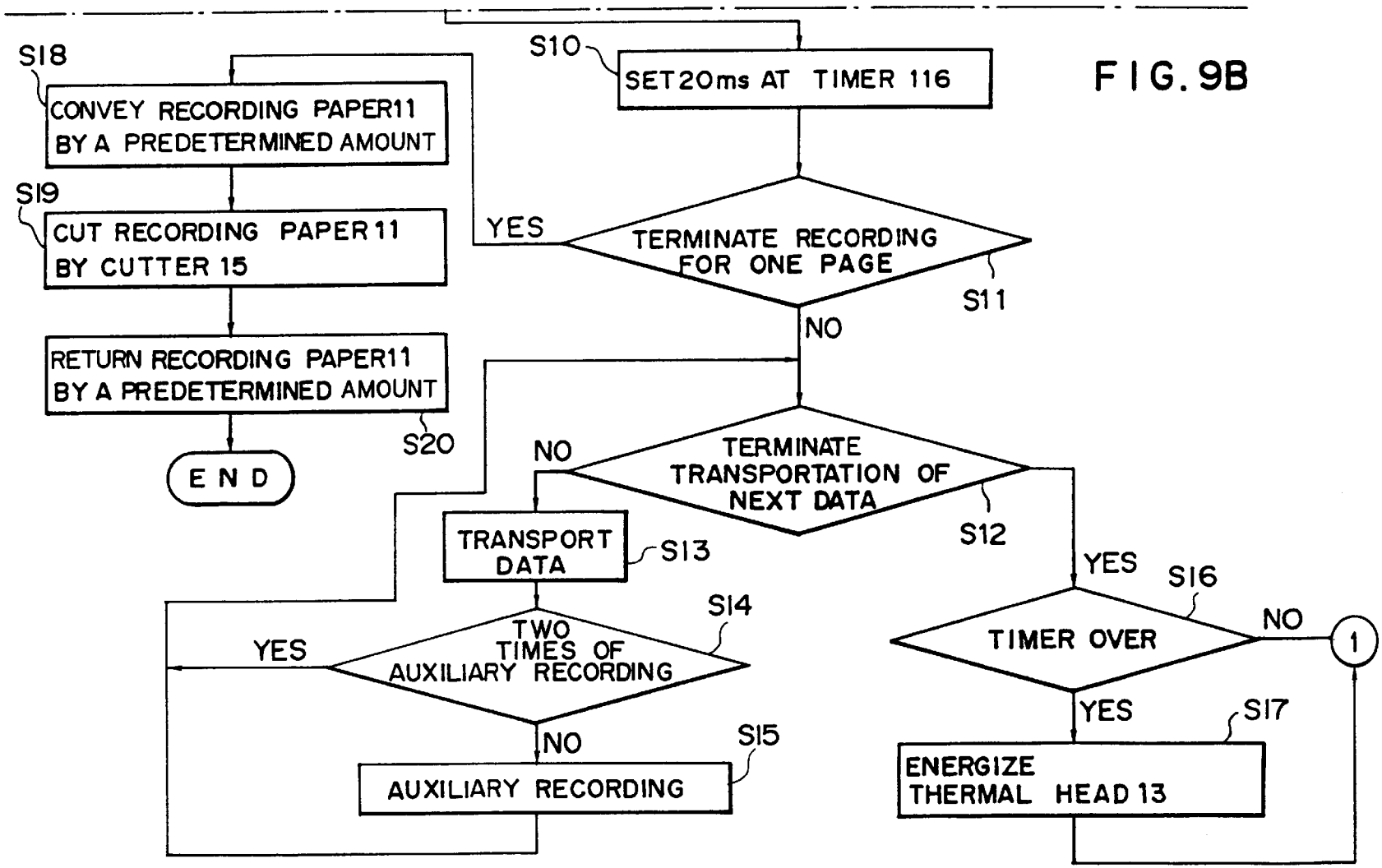
FIG. 9, consisting of FIGS. 9A and 9B, is a flow chart showing a recording process of the embodiment according to the invention.
Figure 10:
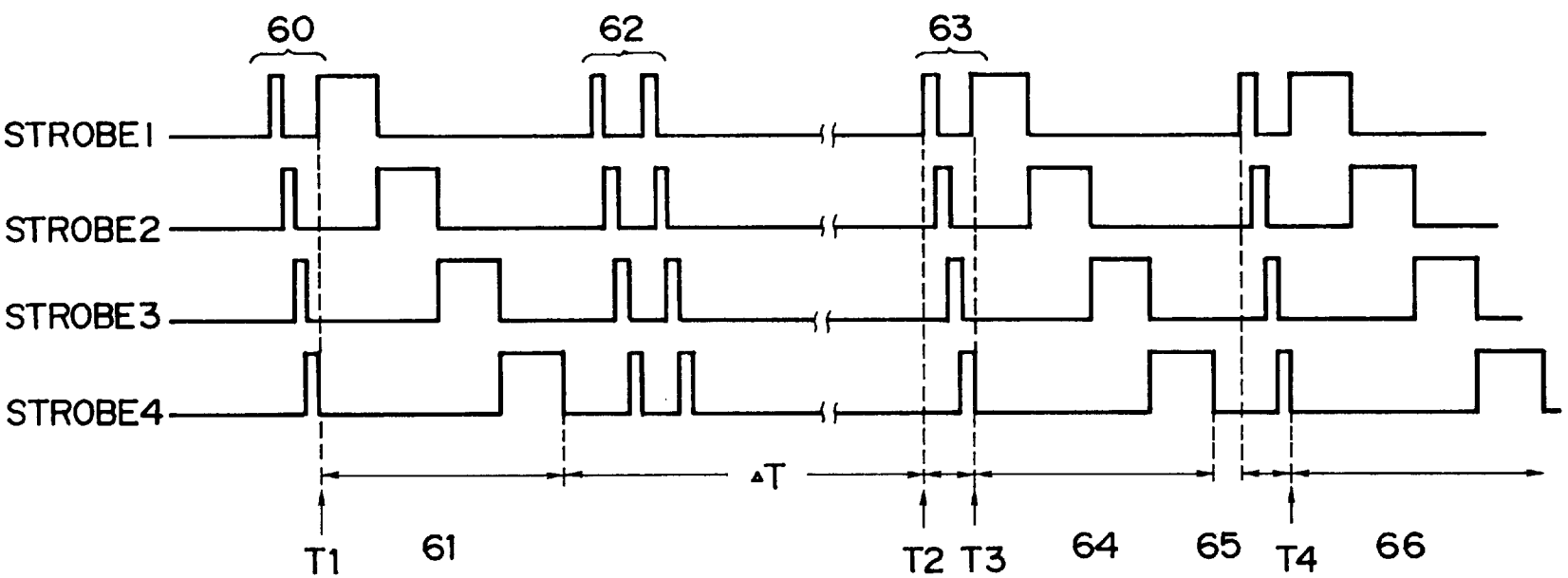
FIG. 10 is a view showing timing of energization of thermal head in a recording process of the embodiment of FIG. 9.

FIGS. 9 and 10 are process flow charts showing a further embodiment.

In this embodiment, after end of recording the same data is recorded again with the recording medium held stationary, and if the recording operation is not performed in a predetermined time period, recording means is caused to generate heat until the next recording operation. In this case, the quality of recorded image can be improved, and also the ink sheet and the recording medium can be readily separated from each other after recording.

In the flow charts of FIGS. 9 and 10, the routine is the same as in the previous embodiment up to step S5. If it is found in step S6 that energization of all the blocks, i.e., recording of one line, has been ended, step S10 is executed, in which a predetermined time (here 20 ms) is set in the timer 116, and the time counting of the timer 116 is started. Then, in step S11 it is checked whether recording of data for one page has been ended. If the recording for one page has not yet been ended, step S12 is executed, in which it is checked whether the next-line data has been transferred to the shift register 130 of the thermal head 13. If not yet, step S13 is executed, in which a data transfer process for transferring data for the next line to the thermal head 13 is executed is the next-line data is ready.

In step S14, it is checked whether auxiliary recording is of the second time. If this is not so, the routine goes to step S15 to perform block-by-block auxiliary recording of the thermal head 13 and then returns to step S12. This means that the thermal head 13 is energized again with the same data (the content of the latch circuit 131 being in the recorded image data). The energization time at this time is about ¼ of the actual energization time in step S5. Thus, it is possible to increase the image density of the present line and prevent white strip that may otherwise be generated with respect to the next line data. If it is found in step S14 that the auxiliary recording is performed two times, the routine returns to step S12 for checking whether the next line data has all been transferred.

If it is found in step S12 that the next line data to be recorded has all been transferred to the thermal head 13, step S16 is executed to check whether the timer 16 is time out, i.e., 20 ms has passed. If 20 ms has not passed, the routine returns to step S2 to latch the next line data in latch circuit 131 and performed the image recording process as noted above.

When 20 ms has passed, step S17 is executed to energize the thermal head 13 by blocks. At this time, data of the latch circuit 131 of the thermal head 13 is equal to the image data for one line data recorded immediately before. Thus, the same data is recorded once again. The energization of the thermal head 13 in step S17 is executed after transfer of the next line data of the shift register 130 of the thermal head 13. This means that it is executed immediately before one line data and also has an effect of preliminarily heating the thermal head 13. The term "immediately before" corresponds to a delay due to the process time up to step S5. Further, the energization time of the thermal head 13 in step S17 may be equal to or shorter than the time of energization in step S5.

When image recording for one page is completed in step 11, step S18 is executed to convey recording sheet 11 toward the discharge rollers 16*a* and 16*b* by a predetermined amount. In step S19, the cutters 15*a*, 15*b* are driven to cut the recording sheet 11 by pages. In subsequent step S20, the recording sheet conveying motor 24 is reversed to return the recording sheet 11 for a distance corresponding to the distance between the thermal head 13 and the cutters 15*a* and 15*b*. Thus, a process of cutting the recording sheet 11 is effected.

As has been shown, in this embodiment auxiliary recording, i.e., recording of the same data once again, is executed after end of recording data for each line. When the time period until recording of the next line data exceeds a predetermined time the thermal head 13 is heated again in step S17. As a result, the quality of recording can be improved, and also the shearing force of ink in the ink layer can be reduced to facilitate the separation of the ink sheet 14 and the recording sheet 11 when the ink sheet 14 and the recording sheet 11 are conveyed in steps S3 and S4.

When driving the thermal head 13 in steps S15 and S17, the energy applied to heat-generator 132 may be reduced as compared with during actual recording. In the driving of the thermal head in step S17, the recording data may be the same as the data of the preceding line to energize heat generating resistors 132 corresponding to black dots in part of the data so as prevent ink from being solidified.

In this embodiment the auxiliary recording is performed two times at the most, but this is by no means limitative.

FIG. 10 shows a timing of energization of the thermal head 13 in the image recording process of this embodiment. In this case, the heat-generating resistors 132 of the thermal head 13 are energized in four blocks.

The strobe signals 1 to 4 respectively correspond to signals for energizing the individual blocks of the heat generating resistors 132 of the thermal head 13.

In the Figure, reference numeral 60 designates energization of the thermal head 13 in step S17 immediately before actual recording process 61. Timing T1 shows a timing at which it is ready for the next line recording with the next line data all transferred to the thermal head 13. Thus, after one line recording as shown at 61 auxiliary recording is performed two times as shown at 62 (step S15). Timing T2 shows a timing at which it is ready to record the next line with the next line data transferred to the thermal head 13. When time AT from the end of recording process shown at 61 is for instance 20 ms or above, preliminary heating is executed as shown at 63.

Shown at 64 is the actual recording for the next line, and 65 auxiliary heating after the recording. In this case, since it is ready to all record data of the next line with the next line data transferred to the thermal head 13 in timing T4, the auxiliary heating has been performed only once. In this case, the thermal head 13 is of course not energized in step S17. Then, next line recording is further executed as shown at 66. In timings T1, T3 and T4 the excitation phases of the recording sheet conveying motor 24 are switched to conveyed the recording sheet 11 for one line (step S4).

The duration of energization of the individual blocks of the thermal head 13 as shown at 60, 62, 63 and 65 is about one-fourth the energization period of actual recording shown at 61, 64 and 66.

[Description of Recording Principles (FIG. 11)]

Figure 11:
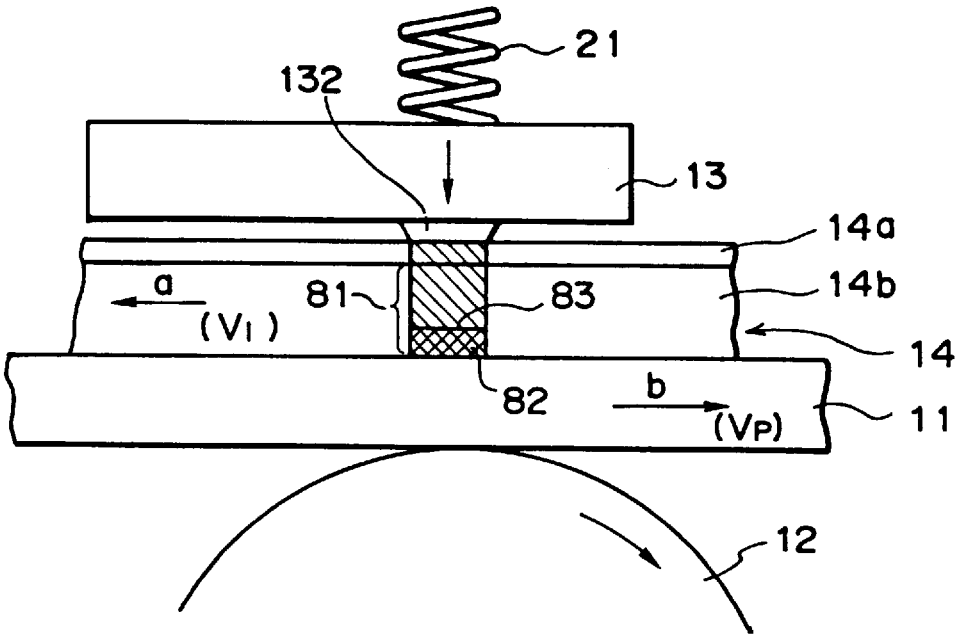
FIG. 11 is a view showing recording sheet and ink sheet at the time of recording of this embodiment.

FIG. 11 is a view showing the embodiment in a state of recording image with the recording sheet 11 and the ink sheet 14 conveyed in opposite directions.

As shown in the Figure, the recording sheet 11 and the ink sheet 14 are clamped between the platen roller 12 and the thermal head 13, and the thermal head 13 is urged by a spring 21 against the platen roller 12 under a predetermined pressure. Here, the recording sheet 11 is conveyed in the direction of arrow b at the speed Vp with rotation of the platen roller 12. Meanwhile, the ink sheet 14 is conveyed at the speed V1 in the direction of arrow a with rotation of the ink sheet conveying motor 25.

When the heat generating resistors 132 of the thermal head 132 are energized by the power source 105 to generate heat, a hatched portion 81 of the ink sheet 14 is heated. Designated at 14*a* is a base film of the ink sheet 14, and 14*b* an ink layer of the ink sheet 14*b*. Ink of the ink layer 81 heated by energizing the heat generating resistors 132 is fursed to be transferred onto the recording sheet 11 as shown at 82. Transferred ink layer portion 82 corresponds substantially to 1/n of the ink layer shown at 81.

At the time of transferring, since a shearing force of ink is produced at borderline 83 of the ink layer 14*b* only the portion 82 should be transferred onto the recording sheet 11. However, the shearing force varies in accordance with the temperature of the ink layer and tends to be reduced with increasing temperature of the ink layer. When reducing the heating time of the ink sheet 14, the shearing force in the ink layer is increased. Therefore, by increasing the relative speed of the ink sheet 14 and the recording sheet 11 the ink layer which is to be transferred can be reliably separated from the ink sheet 14.

With this embodiment, the heating time of the thermal head 13 in the facsimile apparatus is as short as about 0.6 ms. Thus, the ink sheet 14 and the recording sheet 11 are conveyed in the opposite directions to increase relative speed of the ink sheet 14 and the recording sheet 11.

[Description of Ink sheet (FIG. 12)]

Figure 12:
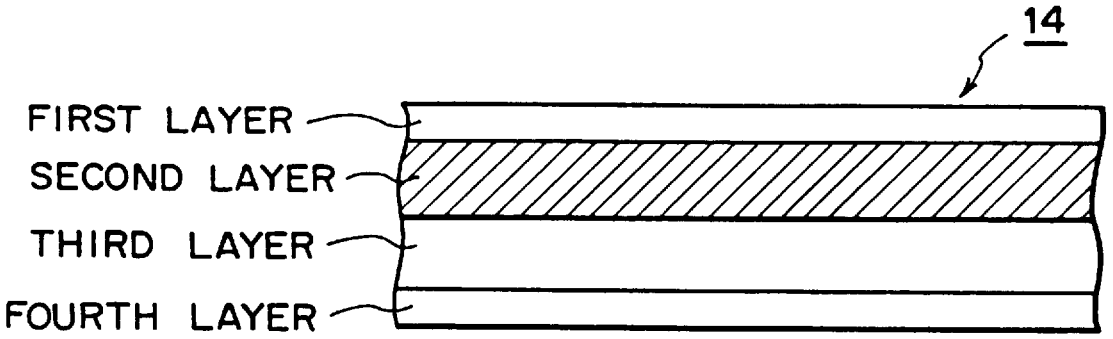
FIG. 12 is a sectional view showing a multi-ink sheet used in the same embodiment.

FIG. 12 is a sectional view showing the ink sheet used in multi-print operation of this embodiment.

The second layer is a base film as support of the ink sheet 14. In the multi-print operation, heat energy is applied many times to the same place. Therefore, it is preferable to use highly heat-resistant aromatic polyamide film or capacitor paper. However, conventional polyester film may be used. These base films advantageously have as small thickness as possible in view of the print quality for they have a role of medium, but they are desirably as thick as 3 to 8 $\mu$m from the standpoint of mechanical strength.

The third layer is an ink layer containing ink in an amount capable of transfer onto recording sheet n times. This ink layer has a composition mainly composed of resin such as EVA as adhesive, carbon black and nigrocin dye for coloring and carnauba wax and paraffin wax as binding agent so that it can withstand n times of use at the same place. The amount of coating is 4 to 8 g/m$^2$. The sensitivity and density are variable depending on the coating amount, and the amount can be selected as desired.

The fourth layer is a top coating layer for preventing ink of the third layer from being transferred under pressure onto the recording sheet, on which no printing is performed. It consists of transparent wax or the like. Thus, only the fourth layer, which is transparent, is transferred under pressure, and it is thus possible to eliminate contamination of the ground of the recording sheet. The first layer is a heat-resistant coating layer for protecting the second layer base film from heat of the thermal head 13. It is suitable for multiprint operation, in which it is possible to apply heat energy for n lines in the same place (i.e., when there are continuous black data). However, it is selective to use the first layer or not. Further, it is effective for a base film having comparatively low heat resistance such as polyester film.

The construction of the ink sheet 14 in this embodiment is by no means limitative; for instance it may consist of a base layer and a porous ink holding layer containing ink provided on one side of the base layer. It may also be a layer formed by a heat resistant ink layer having a fine porous net construction on the base film and the ink layer contains ink therein. Further, the film material may be film or sheet of polyamide, polyethylene, polyester, polyvinyl chloride, triacetylcellulose, nylon, etc. Further, a heat-resistant coat layer is not necessary. However, the material may be silicone resin, epoxy resin, fluorine resin, ethocellose, etc.

Examples of ink ribbon having thermally sublimable ink are those, which comprises a base of such material as polyethylene telephthalate, polyethylene naphthalate, aromatic polyamide film, etc. and a coloring layer containing spacer particles consisting of guanamine resin or fluorine resin and a dye.

The heating system in the thermal transfer printer is not limited to the thermal head system using the thermal head noted above; for instance it is possible to adopt an energization system or a laser transfer system.

This embodiment concerns a case of using a thermal head, but this is by no means limitative; for instance the invention is applicable to a so-called serial thermal transfer printer. Further, the invention is of course applicable to ordinary thermal transfer recording using a one-time ink sheet.

Further, while the above embodiment has concerned with a case of applying the thermal transfer printer to the facsimile apparatus, this is by no means limitative. For example, the thermal transfer recorder according to the invention is applicable to a word processor, a typewriter or a copier.

Further, the recording medium is not limited to the recording paper, but it is also possible to use cloth, plastic sheet, etc. so long as being capable of transfer of ink. Further, the ink sheet is not limited to the roll structure shown in this embodiment. For instance, it is possible to use a commonly termed ink sheet cassette type, in which an ink sheet is accommodated in a casing capable of being detachably mounted in a recorder body.

As has been shown, with this embodiment when the recording time in a thermal transfer printer exceeds a predetermined time, the line image is recorded again. It is thus possible to readily separate ink sheet and recording sheet. Further, in this case, sufficient image density can be obtained.

Further, in this embodiment when a predetermined time period has passed after end of recording of the previous line, the thermal head is energized immediately before recording of data for the next line, it is possible to prevent sticking of the ink sheet and the recording sheet to each other when the two are being transferred.

Further, with this embodiment it is possible to measure time until the next line data is transferred and, when a predetermined time has passed from the instant of end of the previous recording at a timing prior to the completion of transfer, the thermal head is energized again, thus reducing the delay time until the next recording operation after re-heating of the thermal head. By so doing, the adhesion between the recording sheet and ink sheet can be reliably reduced to prevent reduction of the ink temperature when the recording sheet or the ink sheet is being conveyed at the time of the next recording.

This embodiment is effective for a recorder such as a facsimile apparatus, in which the time interval of one line data lacks uniformity and is liable to become excessive.

As has been described in the foregoing, according to the invention if recording operation is not performed for more than a predetermined period of time after end of recording, the separation between the ink sheet and recording medium can be readily separated even after image recording by causing heat generation of the recording means.

We claim:

1. A thermal transfer recording apparatus for recording data on a recording medium by transferring an ink of an ink sheet onto said recording medium, comprising:

ink sheet conveying means for conveying said ink sheet;

recording medium conveying means for conveying said recording medium, said ink sheet and said recording medium being conveyed in a manner such that said ink sheet has a conveyance speed lower than a conveyance speed of said recording medium;

recording means having a plurality of heat generating elements for applying heat energy to said ink sheet;

a latch circuit for latching recording data corresponding to said plurality of heat generating elements;

a shift register for converting said recording data to parallel data and supplying said recording data to said latch circuit, wherein said recording data is transferred to said shift register as serial data;

driving means for driving each of said heat generating elements of said recording means in accordance with the recording data latched by said latch circuit so as to record an image on said recording medium when the recording data transferred to said shift register is latched by said latch circuit; and control means for counting a time after the driving of said recording means and energizing each of said heat generating elements of said recording means in accordance with the recording data previously latched by said latch circuit for auxiliary heating, wherein said heat generating elements are energized after a new recording data comprising recording data for a line to be recorded next is transferred to said shift register and only when said time, at a termination of transfer of said new recording data to said shift register, is longer than a predetermined time period, and for causing said latch circuit to latch said new recording data after said heat generating elements are energized.

2. An apparatus according to claim 1, wherein said control means energizes each of said heat generating elements of said recording means in accordance with data which is recording data in a preceding recording.

3. An apparatus according to claim 1, wherein said plurality of heat generating elements are divided into a plurality of blocks and said control means causes said heat generating elements of said recording means to be energized by said blocks.

4. An apparatus according to claim 1, wherein said control means energizes again each of said heat generating elements of said recording means in accordance with the recording data latched by said latch circuit without conveying said recording medium after said recording means is driven by said driving means.

5. An apparatus according to claim 1, wherein said control means forecasts a transfer completion time until a next recording data is transferred to said shift register and causes heat generation in accordance with the recording data latched by said latch circuit when the counted time is more than a predetermined value and at least said predetermined time period remains before said transfer completion time.

6. An apparatus according to claim 1, wherein said control means causes each of said heat generating elements to be energized immediately after said recording data is transferred to said shift register.

7. A thermal transfer recording apparatus according to one of claims 1 to 5, wherein said ink sheet has an amount of said ink sufficient to permit a transfer of said ink a plurality of times from a particular region of said ink sheet.

8. An apparatus according to claim 1, further comprising:

reading means for reading an original image and providing an image signal; and transmitting/receiving means, connected to said reading means, for transmitting and receiving said image signal for recording by said recording means, wherein said driving means drives each of said heat generating elements of said recording means in accordance with said recording data responsive to said reading means and said image signal from said reading means.

9. An apparatus according to claim 1, wherein said thermal transfer recording apparatus is a facsimile apparatus.

10. A thermal transfer recording method for recording data on a recording medium by transferring an ink of an ink sheet onto said recording medium, said method comprising the steps of:

a first transferring step for transferring recording data to a shift register;

a first recording step for latching the recording data transferred to said shift register by a latch circuit and for recording a first image on said recording medium by recording means for applying heat energy to said ink sheet, said recording means having a plurality of heat generating elements which apply said heat energy at a first energy level in accordance with the recording data latched by said latch circuit;

a counting step for counting a time after said first recording step;

a second transferring step for transferring new recording data to said shift register;

a preheat drive step for driving each of said heat generating elements in accordance with the recording data previously latched by said latch circuit at a second energy level for auxiliary heating after said second transferring step, wherein said heat generating elements are driven only when the time counted in said counting step is longer than a predetermined time period, and said second energy level is lower than said first energy level; and a second recording step for latching the new recording data transferred to said shift register and for recording a second image on said recording medium by said recording means at the first energy level in accordance with the new recording data latched by said latch circuit, the new recording data being latched after said preheat drive step.

11. A thermal transfer recording apparatus for recording data on a recording medium by transferring an ink of an ink sheet onto said recording medium, comprising:

ink sheet conveying means for conveying said ink sheet;

recording medium conveying means for conveying said recording medium, said ink sheet having a conveyance speed lower than a conveyance speed of said recording medium;

recording means for recording having a plurality of heat generating elements each applying heat energy to said ink sheet;

a latch circuit for latching recording data corresponding to said plurality of heat generating elements;

a shift register for converting said recording data to parallel data and supplying said recording data to said latch circuit, wherein said recording data is transferred to said shift register as serial data;

driving means for driving each of said heat generating elements of said recording means in accordance with the recording data latched by said latch circuit so as to record an image on said recording medium when the recording data transferred to said shift register is latched by said latch circuit;

time counting means for counting a time period after said recording means is driven by said driving means; and control means for energizing each of said heat generating elements of said recording means in accordance with the recording data previously latched by said latch circuit for auxiliary heating after a new recording data comprising recording data for a line to be recorded next is transferred to said shift register and only when said time period, at a termination of transfer of said new recording data to said shift register, is longer than a predetermined time period and for causing said latch circuit to latch the new recording data after said termination of transfer.

12. An apparatus according to claim 11, wherein said control means energizes each of said heat generating elements of said recording means in accordance with a data which is the same as said recording data.

13. An apparatus according to claim 11, wherein said control means forecasts a transfer completion time until a next recording data is transferred to said shift resister and causes heat generation in accordance with the recording data latched by said latch circuit when the time period counted by said time counting means is more than a predetermined value and at least said predetermined time period remains before said transfer completion time.

14. A thermal transfer recording apparatus according to claim 11, wherein said control means reduces said heat energy when recording is not conducted as compared with a level of said heat energy at a time of said recording by said recording means.

15. An apparatus according to claim 11, further comprising:

reading means for reading an original image and providing an image signal; and transmitting/receiving means, connected to said reading means, for transmitting and receiving said image signal for recording by said recording means, wherein said driving means drives each of said heat generating elements of said recording means in accordance with said recording data responsive to said reading means and said image signal from said reading means.

16. An apparatus according to claim 11, wherein said ink sheet has an amount of said ink sufficient to permit a transfer of said ink a plurality of times from a given region of said ink sheet.

17. An apparatus according to claim 11, wherein said thermal transfer recording apparatus is a facsimile apparatus.

18. A thermal transfer recording apparatus for recording data on a recording medium by transferring an ink of an ink sheet onto said recording medium, comprising:

ink sheet conveying means for conveying said ink sheet;

recording medium conveying means for conveying said recording medium, said ink sheet having a conveyance speed lower than a conveyance speed of said recording medium;

recording means having a plurality of heat generating elements each applying heat energy to said ink sheet;

a latch circuit for latching recording data corresponding to said plurality of heat generating elements;

a shift register for converting said recording data to parallel data and supplying said recording data to said latch circuit, wherein said recording data is transferred to said shift register as serial data;

driving means for driving each of said heat generating elements of said recording means in accordance with the recording data latched by said latch circuit so as to record an image on said recording medium when the recording data transferred to said shift register is latched by said latch circuit;

time counting means for counting a time period after said recording means is driven by said driving means; and control means for energizing again each of said heat generating elements of said recording means in accordance with the recording data latched by said latch circuit without conveying said recording medium after said recording means is driven by said driving means, said control means energizing each of said heat generating elements of said recording means in accordance with the recording data latched by said latch circuit for auxiliary heating after new recording data comprising recording data for a line to be recorded next is transferred to said shift register only when the time period counted by said time counting means, at a termination of transfer of the new recording data to said shift register, is longer than a predetermined time period, and wherein said latch circuit latches the new recording data after said termination of transfer.

19. An apparatus according to claim 18, wherein said plurality of heat generating elements are divided into a plurality of blocks and said control means energizes said heat generating elements of said recording means by said blocks.

20. An apparatus according to claim 18, wherein said control means forecasts a transfer completion time until a next recording data is transferred to said shift register and causes heat generation again in accordance with the recording data latched by said latch circuit when the time period counted by said time counting means is more than a predetermined value and at least a predetermined time period remains before said transfer completion time.

21. A thermal transfer recording apparatus according to claim 18, wherein said control means reduces said heat energy when recording is not conducted as compared with a level of said heat energy at a time of recording by said recording means for recording of data on said recording medium or heating of said ink sheet.

22. An apparatus according to claim 18, further comprising:

reading means for reading an original image and providing an image signal; and transmitting/receiving means, connected to said reading means, for transmitting and receiving said image signal for recording by said recording means, wherein said driving means drives each of said heat generating elements of said recording means in accordance with said recording data responsive to said reading means and said image signal from said reading means.

23. An apparatus according to claim 11, wherein said control means energizes each of said heat generating elements immediately after said recording data is transferred to said shift register.

24. An apparatus according to claim 18, wherein said control means energizes each of said heat generating elements immediately after said recording data is transferred to said shift register.

25. An apparatus according to claim 18, wherein said ink sheet has an amount of said ink sufficient to permit a transfer of said ink a plurality of times from a given region of said ink sheet.

26. An apparatus according to claim 18, wherein said thermal transfer recording apparatus is a facsimile apparatus.

27. A thermal transfer recording apparatus for recording data on a recording medium by transferring an ink of an ink sheet onto said recording medium, said apparatus comprising:

recording means for recording having a plurality of heat generating elements for applying heat energy to said ink sheet, said ink sheet having an amount of said ink sufficient to permit a transfer of said ink a plurality of times from a given region of said ink sheet;

ink sheet conveying means for conveying said ink sheet;

recording medium conveying means for conveying said recording medium, said ink sheet having a conveyance speed lower than a conveyance speed of said recording medium;

a latch circuit for latching recording data corresponding to said plurality of heat generating elements;

a shift register for converting said recording data to parallel data and supplying said recording data to said latch circuit, wherein said recording data is transferred to said shift register as serial data;

driving means for driving each of said heat generating elements of said recording means in accordance with the recording data latched by said latch circuit so as to record an image on said recording medium when the recording data transferred to said shift register is latched by said latch circuit; and control means for counting a time period after the driving of said recording means and energizing each of said heat generating elements of said recording means in accordance with the recording data previously latched by said latch circuit for auxiliary heating, wherein said heat generating elements are energized after a new recording data comprising recording data for a line to be recorded next is transferred to said shift register and only when said time period is longer than a predetermined time period, and wherein said latch circuit latches the new recording data after said heat generating elements are energized.

28. An apparatus according to claim 27, wherein said control means energizes each of said heat generating elements immediately after said recording data is transferred to said shift register.

29. An apparatus according to claim 27, wherein said thermal transfer recording apparatus is a facsimile apparatus.

* * * * *

UNITED STATES PATENT AND TRADEMARK OFFICE

CERTIFICATE OF CORRECTION

PATENT NO. : 6,069,643

DATED : May 30, 2000

INVENTOR(S) : TAKEHIRO YOSHIDA ET AL.

It is certified that error appears in the above-identified patent and that said Letters Patent is hereby corrected as shown below:

ON THE TITLE PAGE:

[56] References Cited under U.S. PATENT DOCUMENTS

"Terajioma" should read --Terajima--.

COLUMN 2:

Line 59, "EMBODIMENT" should read --EMBODIMENTS--; and
Line 60, "now" should be deleted.

COLUMN 3:

Line 5, "view" should read --view showing--;
Line 11, "by" should read --thereby--; and
Line 57, "a" should read --wound--.

COLUMN 4:

Line 18, "recording" should read --of a recording--; and
Line 60, "roller 18" should read --roller 71.

COLUMN 6:

Line 42, "timer 116," should read --timer 116--.

COLUMN 7:

Line 13, "level," should read --level--.

UNITED STATES PATENT AND TRADEMARK OFFICE

CERTIFICATE OF CORRECTION

PATENT NO. : 6,069,643

DATED : May 30, 2000

INVENTOR(S) : TAKEHIRO YOSHIDA ET AL.

It is certified that error appears in the above-identified patent and that said Letters Patent is hereby corrected as shown below:

COLUMN 8:

Line 56, "timer 16" should read --timer 116--; and
Line 59, "performed" should read --to perform--.

COLUMN 9:

Line 10, "11," should read --S11,--;
Line 54, "time AT" should read --time ΔT--;
Line 59, "65" should read --at 65--; and
Line 67, "conveyed" should read --convey--.

COLUMN 10:

Line 20, "head 132" should read --head 13--;
Line 23, "sheet 14b." should read --sheet 14.--;
Line 25, "fursed" should read --first--; and
Line 46, "sheet" should read --Sheet--.

COLUMN 11:

Line 9, "multiprint" should read --multi-print--;
Line 27, "those," should read --those--;
Line 28, "telephthalate," should read --terephthalate,--; and
Line 41, "with" should be deleted.

UNITED STATES PATENT AND TRADEMARK OFFICE

CERTIFICATE OF CORRECTION

PATENT NO. : 6,069,643

DATED : May 30, 2000

INVENTOR(S) : TAKEHIRO YOSHIDA ET AL.

It is certified that error appears in the above-identified patent and that said Letters Patent is hereby corrected as shown below:

COLUMN 12:

Line 19, "separated" should read --be done--.

Signed and Sealed this

Eighth Day of May, 2001

Nicholas P. Godici

NICHOLAS P. GODICI

*Acting Director of the United States Patent and Trademark Office*

*Attest:*

*Attesting Officer*